US009534353B1

(12) United States Patent
Parsley

(10) Patent No.: US 9,534,353 B1
(45) Date of Patent: Jan. 3, 2017

(54) MACHINE FOR DIGGING OR REFURBISHING SWALES

(71) Applicant: DeSoto Excavating, Inc., Arcadia, FL (US)

(72) Inventor: Charles Stewart Parsley, Arcadia, FL (US)

(73) Assignee: DeSoto Excavating, Inc., Arcadia, FL (US)

( * ) Notice: Subject to any disclaimer, the term of this patent is extended or adjusted under 35 U.S.C. 154(b) by 0 days.

(21) Appl. No.: 14/481,142

(22) Filed: Sep. 9, 2014

(51) Int. Cl.
*E02F 3/20* (2006.01)
*E02F 5/08* (2006.01)

(52) U.S. Cl.
CPC .. *E02F 5/08* (2013.01); *E02F 3/20* (2013.01)

(58) Field of Classification Search
CPC ..... A01B 13/00; E02F 3/241; E02F 3/20; E02F 3/185; E02F 3/183; E02F 3/38; E02F 5/027; E02F 5/00; E02F 5/08; E02F 3/7677
USPC ..... 37/91–94, 109, 195
See application file for complete search history.

(56) References Cited

U.S. PATENT DOCUMENTS 4,682,427 A * 7/1987 Dondi ..... E02F 3/38 172/125
4,887,372 A * 12/1989 Block ..... E02F 3/20 172/49.5
5,113,610 A * 5/1992 Liebrecht, Jr. ..... A01B 13/00 37/189
5,255,454 A * 10/1993 Pounds ..... E02F 3/20 37/189
6,341,435 B1 * 1/2002 Erickson ..... E02F 5/027 172/149
6,418,647 B1 * 7/2002 Erickson ..... E02F 5/027 172/149
7,627,964 B2 * 12/2009 Vaags ..... A01B 13/00 172/149

* cited by examiner

*Primary Examiner* — Robert Pezzuto
(74) *Attorney, Agent, or Firm* — Nicholas Pfeifer; Smith & Hopen, P. A.

(57) ABSTRACT

A machine for forming an elongate swale in an earth surface includes a motor for powering the machine along a predetermined path of travel, a first blade housing, a second blade housing, the first and second blade housings being positioned on opposite sides of a longitudinal axis of symmetry of the machine at a predetermined angle with respect to the earth surface. A first disc is rotatably mounted in the first blade housing and a second disc is rotatably mounted in the second blade housing. The first and second discs are counter-rotated by the motor. Each of the discs has at least two blades secured to an outer peripheral edge in diametrically opposed relation to one another. The two blades include a digging blade a sweeping blade. Each digging blade depending downwardly from the plane of the disc and each sweeping blade extending upwardly from the plane of the disc.

4 Claims, 3 Drawing Sheets

MACHINE FOR DIGGING OR REFURBISHING SWALES

BACKGROUND OF THE INVENTION

1. Field of the Invention

This invention relates, generally, to machinery. More particularly, it relates to a swale-digging machine that may be towed by a tractor.

2. Description of the Prior Art

A swale can be a natural depression formed in land. It can also be a man-made depression such as an elongate ditch. For example, a swale may be formed in farmland to collect rainwater as a water conservation measure. In an orange grove formed by multiple rows of orange trees, an elongate man-made swale may be formed between each row of trees so that each row of trees grows in dry ground that is elevated relative to a swale on each side of each row. The swale collects rainwater and each tree can draw upon the water in the swale as needed. In this way, the earth directly under the branches of the tree remains dry as required for the health of the tree. Advantageously, the trees that benefit from the swale provide shade which decreases the rate of water evaporation from the swale.

Several tools for digging swales have been invented, but they operate very slowly, traveling at speeds less than a quarter mile per hour. Moreover, some of the known devices form swales having steep banks with the removed earth stacked at the top of the banks. These swales re-fill when rain causes the stacked earth to slide down the steep banks.

Thus there is a need for a swale digging machine that operates at a faster rate of speed than the known machines, which builds swales having banks that are not steep, and which does not stack the removed earth at the top of the banks where it can be washed back down into the swale by rainfall.

However, in view of the art considered as a whole at the time the present invention was made, it was not obvious to those of ordinary skill in the art how the needed structure could be provided.

SUMMARY OF THE INVENTION

The long-standing but heretofore unfulfilled need for a device that digs new or refurbishes old swales is now met by a new, useful, and non-obvious invention.

The novel machine for forming an elongate swale in an earth surface includes a motor for powering the machine along a predetermined path of travel. It further includes a first blade housing and a second blade housing. The first and second blade housings are positioned on opposite sides of a longitudinal axis of symmetry of the machine at a predetermined angle with respect to the surface of the earth.

A first disc is rotatably mounted in the first blade housing and a second disc is rotatably mounted in the second blade housing. The first and second discs are counter-rotated by the motor, i.e., the first disc rotates counterclockwise and the second disc rotates clockwise.

Each of the discs has at least two (2) blades secured to an outer peripheral edge thereof in diametrically opposed relation to one another. Each blade of the at least two (2) blades includes a digging blade a sweeping blade. Each digging blade is mounted to its rotating disc so that most of the digging blade depends downwardly from the plane of the disc. Each digging blade therefore engages and digs into the earth it contacts as it is driven in a circular path of travel. Each sweeping blade is mounted to its rotating disc so that most of the sweeping blade extends upwardly from the plane of the disc. Each sweeping blade therefore sweeps the earth it contacts as it is driven in a circular path of travel. Each digging blade separates a layer of earth from the earth as each digging blade rotates and a separated layer of earth forms a loose mound of earth that is elevated with respect to the surface of the earth that is not contacted by a digging blade. Each sweeping blade associated with the first disc sweeps the elevated, loosened earth forwardly and to a first side as the machine travels along its predetermined path of travel and each sweeping blade associated with the second disc sweep the elevated, loosened earth forwardly and to a second side as the machine travels along said predetermined path of travel.

The first disc is connected to a shaft that is rotated by a first secondary gearbox and the said second disc is connected to a shaft that is rotated by a second secondary gearbox. A primary gearbox is connected in driving relation to the first and second secondary gearboxes and in driven relation to a power take off shaft of the motor.

Each of the discs are disposed approximately at a twenty degree (20°) angle with respect to the surface of the earth.

In a preferred embodiment, each of the discs has eight (8) blades mounted to a periphery thereof, each blade being circumferentially spaced forty five degrees (45°) from its adjacent blades.

The primary object of the invention is to provide a swale digging machine that outperforms other such machines in linear speed of travel.

Another important object is to provide a swale-digging machine that produces high quality swales.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
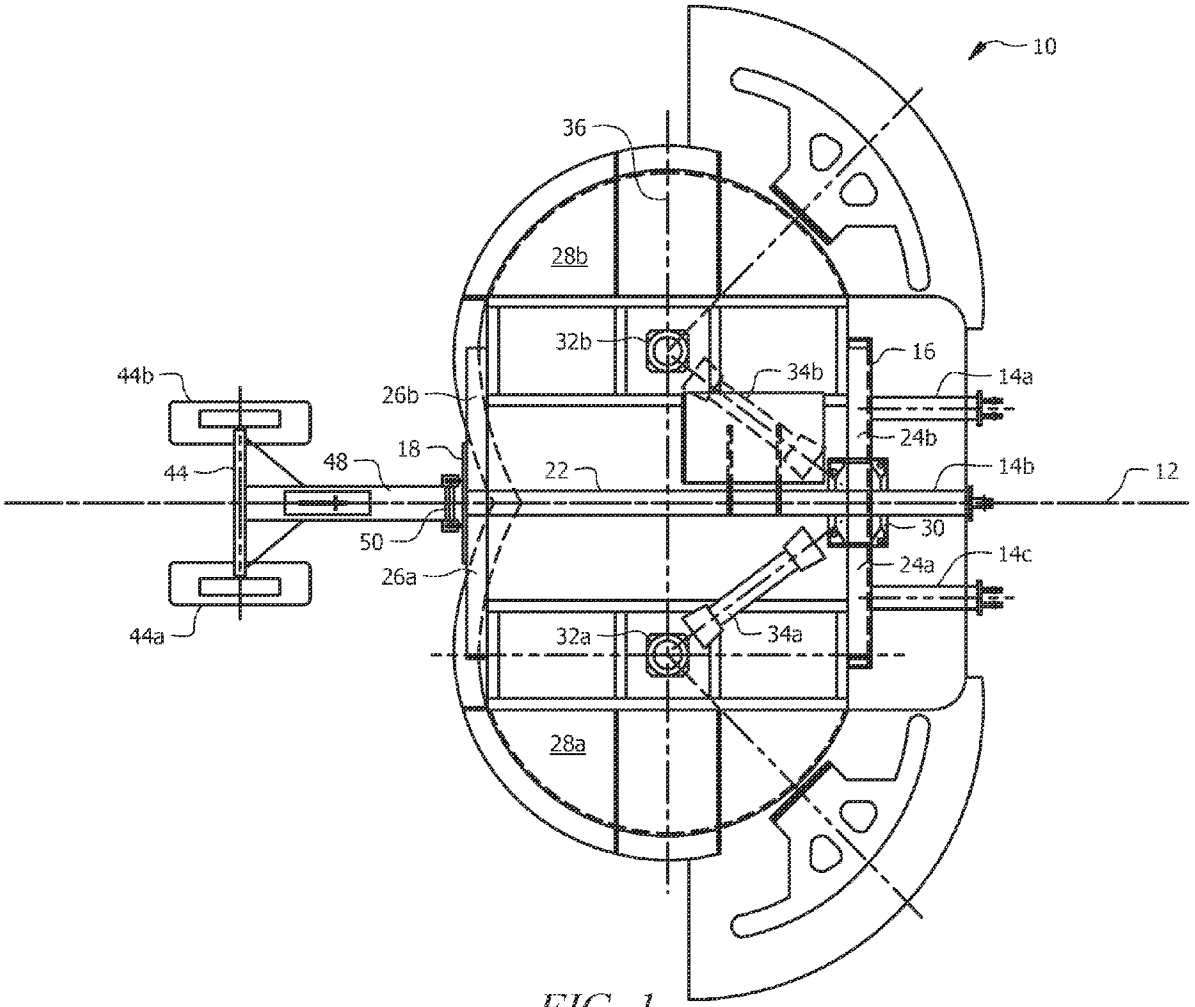
FIG. 1 is a top plan view of the novel structure.

FIG. 1 depicts an illustrative embodiment of the novel structure which is denoted as a whole by the reference numeral 10.

In the preferred embodiment, machine 10 is not self-propelled but it is within the scope of this invention to provide it with such propulsion.

Machine 10 is preferably towed along a predetermined centerline by a self-propelled vehicle such as a tractor, not depicted. The speed of the tractor is between a quarter of a mile per hour to half a mile per hour. The longitudinal axis of symmetry of machine 10 is denoted 12 in the top plan view of FIG. 1. Longitudinal axis 12 is coincident with the predetermined centerline when the machine is towed along said centerline by said tractor.

Conventional hitch has three (3) longitudinally disposed arms 14*a*, 14*b*, and 14*c* that are secured at their respective leading ends to a tractor in a well-known way and at their respective trailing ends to leading transversely disposed beam 16 which forms part of novel machine 10. Trailing transversely disposed beam 18 is parallel to leading transversely disposed beam 16 and is connected to leading transversely disposed beam 16 by central longitudinal beam 20 which is depicted in the side elevation view of FIG. 2. Central longitudinal beam 20 is blocked from view in FIG. 1 by upper longitudinal beam 22.

Figure 2:
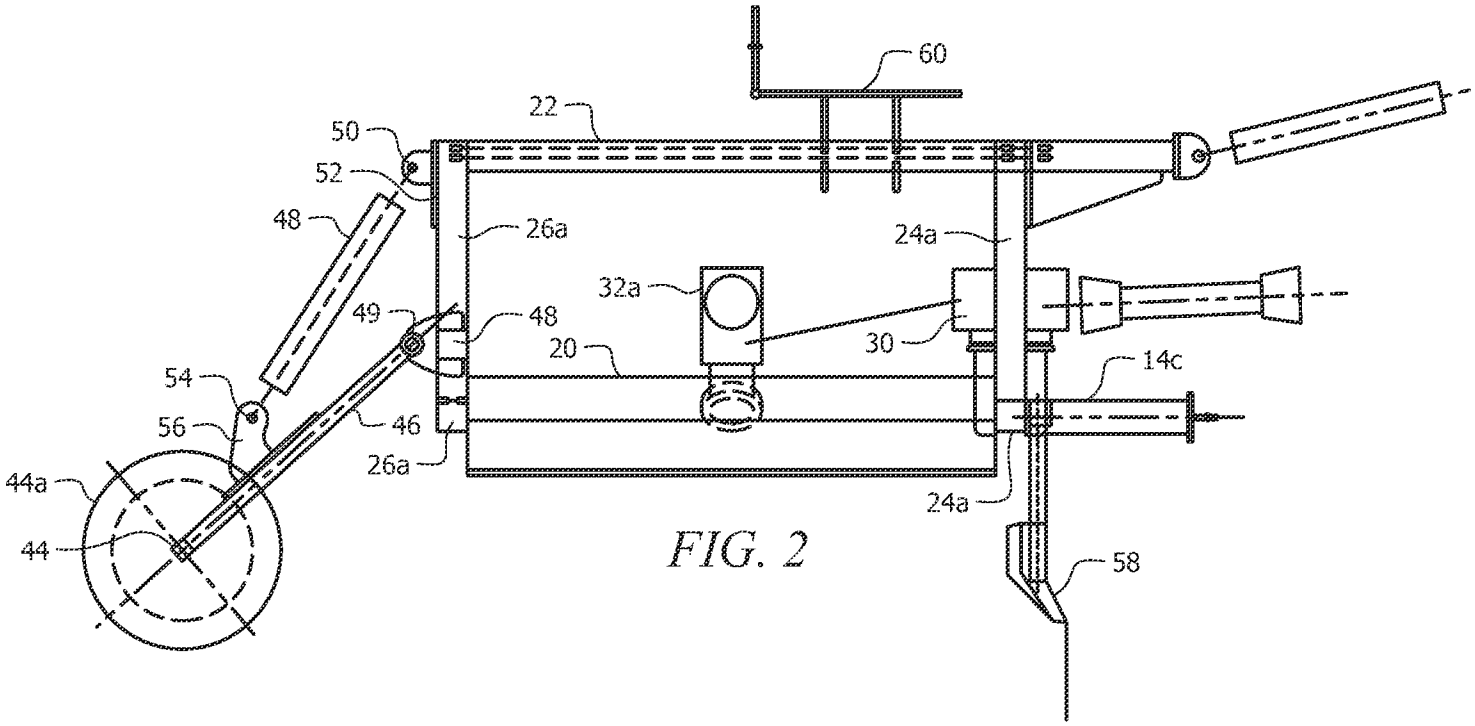
FIG. 2 is a side elevation view thereof.
Figure 3:
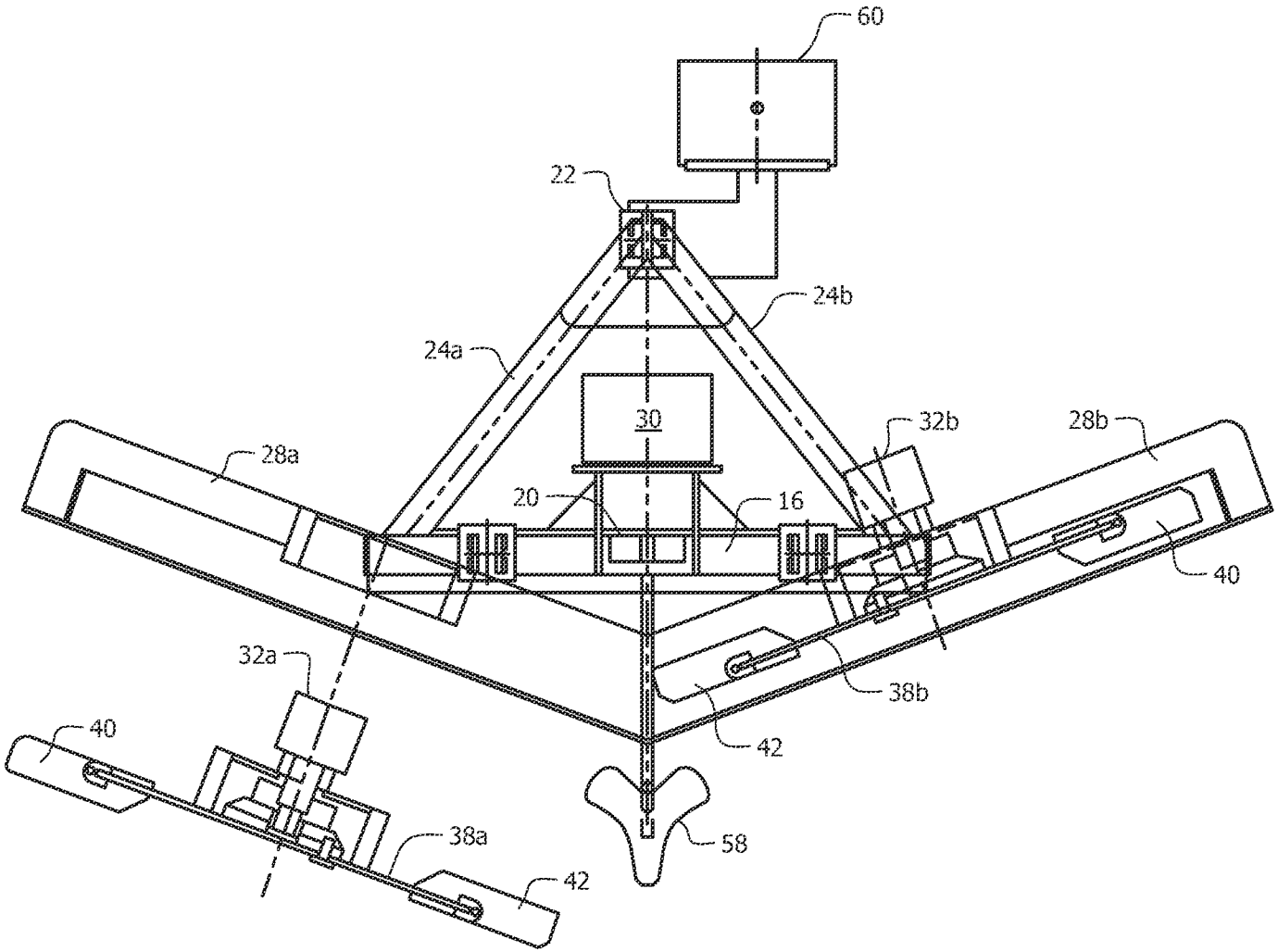
FIG. 3 is a partially exploded, front elevation view thereof.

As best understood from inspection of FIGS. 2 and 3, a forward pair of beams 24*a*, 24*b*, interconnects the leading end of upper longitudinal beam 22 to opposite ends of leading transversely disposed beam 16 and a rearward pair of beams 26*a*, 26*b*, interconnects the trailing end of upper longitudinal beam 22 to opposite ends of trailing transversely disposed beam 18.

Machine 10 further includes two (2) blade housings, there being one (1) blade housing on each side of longitudinal center line 12. The housings are denoted 28*a*, 28*b* because they share a common structure. As best understood in connection with the front view of FIG. 3, housings 28*a* and 28*b* are preferably disposed at a twenty degree (20°) angle or so, relative to horizontal. In this preferred embodiment, that is a permanent angle. However, it is within the scope of this invention to make the angle of said housings adjustable. As a practical matter, it is more economical to manufacture each machine so that its housings are mounted at a permanent angle. Thus, an angle of thirty degrees (30°) can be provided by special order if an orange grove owner prefers swales having thirty degree (30°) banks, for example.

Primary gearbox 30 is mounted to leading transversely disposed beam 16 and is driven by the power take off shaft of the tractor, said power take-off shaft being inside hollow arm 14*b* of the conventional hitch. As perhaps best illustrated in FIG. 1, secondary gearboxes 32*a*, 32*b* are interconnected with primary gearbox 30 by rotating shafts 34*a*, 34*b*. Secondary gearboxes 32*a*, 32*b*, as illustrated in FIG. 1, are disposed on opposite sides of longitudinal axis 12 in equidistantly spaced relation thereto. Moreover, secondary gearboxes 32*a*, 32*b* are centered on transverse axis 36 which bisects central longitudinal beam 20. Each secondary gearbox is therefore centered with respect to its associated housing 28*a*, 28*b* as perhaps best understood by comparing FIGS. 1 and 3.

As best depicted in FIG. 3, disc 38*a* is mounted for conjoint rotation to a shaft that is rotated in a first direction by secondary gearbox 32*a*, and disc 38*b* is mounted for conjoint rotation to a shaft that is rotated in a direction opposite to said first direction by secondary gearbox 32*b*. The rotation of each disc 38*a*, 38*b* is best understood in connection with FIG. 1, i.e., disc 38*a* rotates counterclockwise to throw dirt forwardly and to the left as the tractor travels from left to right and disc 38*b* rotates clockwise to throw dirt forwardly and to the right.

More particularly, each disc has at least two (2) blades secured to its outer peripheral edge in diametrically opposed relation to one another. However, a preferred embodiment includes eight (8) blades, each blade being circumferentially spaced forty five degrees (45°) from its adjacent blades.

There are two (2) types of blades, the first type being a digging blade 40 and the second type being a sweeping blade 42. As best depicted in FIG. 3, each digging blade is mounted to its rotating disc 38*a*, 38*b* so that most of the blade depends downwardly from the plane of the disc. Each digging blade 40 thus engages and digs into the earth it contacts as it is driven in a circular path of travel by its associated secondary gearbox. Each sweeping blade 42 is mounted to its rotating disc 38*a*, 38*b* so that most of the blade extends upwardly from the plane of the disc. Each sweeping blade 42 thus sweeps the earth it contacts as it is driven in a circular path of travel by its associated secondary gearbox. Each digging blade 40 separates a layer of earth from the earth as it rotates, and such dug-up earth forms a loose mound of earth that is elevated with respect to the surface of earth that is not contacted by a digging blade. Each sweeping blade 42 associated with rotating disc 38*a* thus performs the function of sweeping that elevated, loosened earth forwardly and to the left as the tractor travels from left to right as aforesaid and each sweeping blade 42 associated with rotating disc 38*b* thus performs the function of sweeping elevated, loosened earth forwardly and to the right as said tractor travels in said forward direction.

If the tractor does not travel, the machine creates a pair of toroidal ditches in the earth on opposite sides of the longitudinal axis of the machine where each ditch is sloped at said twenty degree (20°) angle to form converging, i.e., V-shaped (when viewed in front elevation) opposite or mirror image banks. The width of each toroidal ditch would be about the length of each digging blade 40. An elongate swale is created when the machine is towed along said predetermined centerline by a driver of the tractor.

A pair of transversely spaced apart wheels 44*a*, 44*b* are rotatably secured to opposite ends of axle 44 and rod 46 pivotally secures said axle to transverse mounting beam 48 at pivot point 49. Transverse mounting beam 48 is parallel to trailing transversely disposed beam 18 and the opposite ends of said beam 48 are secured to rearward pair of beams 26*a*, 26*b*. Shock absorber 48 has a first, upper end pivotally connected as at 50 to an ear or lug mounted to and which projects from plate 52 in a trailing direction. Plate 50 is secured to the frame near upper longitudinal beam 22 and a second, lower end pivotally connected as at 54 to a mounting member 56 that is secured to said rod 46. This structure provides a robust support for the trailing end of machine 10.

Plow 58 at the leading end of machine 10 is optional. It depends from the center of leading transverse beam 16 as depicted in FIG. 3. It loosens soil that may escape the digging blades of each disc if the digging blades are positioned as depicted in FIG. 3. However, plow 58 is superfluous if blades 40, 42 overlap one another.

A GPS system 60 may be mounted atop upper longitudinal beam 22. With appropriate software, the tractor could follow said predetermined centerline without a driver.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween.

What is claimed is:

1. A machine for forming an elongate swale in an earth surface, comprising:

a motor for powering said machine along a predetermined path of travel;

a first blade housing;

a second blade housing;

said first and second blade housings being positioned on opposite sides of a longitudinal axis of symmetry of said machine at a predetermined angle with respect to the earth surface;

a first disc rotatably mounted in said first blade housing and a second disc rotatably mounted in said second blade housing;

said first and second discs being counter-rotated by said motor;

each of said discs having an upper surface and a lower surface with an outer peripheral edge spanning between said upper and lower surfaces, and at least two (2) blades secured to said outer peripheral edge thereof in diametrically opposed relation to one another;

said at least two (2) blades including a digging blade and a sweeping blade;

each digging blade mounted to its rotating disc so that most of the digging blade depends downwardly from the lower surface of the disc so that each digging blade engages and digs into the earth it contacts as it is driven in a circular path of travel by said motor;

each sweeping blade mounted to its rotating disc so that most of the sweeping blade extends upwardly from the upper surface of the disc so that each sweeping blade sweeps the earth it contacts as it is driven in a circular path of travel by its motor;

whereby each digging blade separates a layer of earth from the earth as each digging blade rotates;

whereby separated layer of earth forms a loose mound of earth that is elevated with respect to the surface of the earth that is not contacted by a digging blade;

whereby each sweeping blade associated with said first disc sweeps said elevated, loosened earth forwardly and to a first side as the machine travels along said predetermined path of travel and each sweeping blade associated with said second disc sweep the elevated, loosened earth forwardly and to a second side as the machine travels along said predetermined path of travel.

2. The machine of claim 1, further comprising:

said first disc being connected to a shaft that is rotated by a first secondary gearbox;

said second disc being connected to a shaft that is rotated by a second secondary gearbox;

a primary gearbox connected in driving relation to said first and second secondary gearboxes;

said primary gearbox being connected in driven relation to a power take off shaft of said motor.

3. The machine of claim 2, further comprising:

each of said discs being disposed approximately at a twenty degree (20°) angle with respect to said surface of the earth.

4. The machine of claim 3, further comprising:

each of said discs having eight (8) blades mounted to a periphery thereof, each blade being circumferentially spaced forty-five degrees (45°) from its adjacent blades.

* * * * *